United States Patent [19]

Resta et al.

[11] Patent Number: 4,669,405

[45] Date of Patent: Jun. 2, 1987

[54] QUILTING MACHINE WITH RELATIVELY MOVING CLOTH HOLDER CARRIAGE AND SEWING HEAD

[75] Inventors: Rodolfo Resta; Mario Resta; Roberto Resta, all of Faenza, Italy

[73] Assignee: Antonia Resta Meccanica S.d.f. di Resta Mario e Berardi, Faenza, Italy

[21] Appl. No.: 653,794

[22] Filed: Sep. 24, 1984

[30] Foreign Application Priority Data

Sep. 30, 1983 [IT] Italy ..... 3574 A/83

[51] Int. Cl.[4] ..... D05B 3/00

[52] U.S. Cl. ..... 112/121.14; 112/103; 112/119

[58] Field of Search ..... 112/121.11, 121.14, 112/121.12, 121.15, 112, 2, 102, 103, 90, 86, 220, 118, 119

[56] References Cited

U.S. PATENT DOCUMENTS

| | | | |
|---|---|---|---|
| 2,059,845 | 11/1936 | Bowersox | 112/121.14 X |
| 3,046,921 | 7/1962 | Schwarzberger | 112/118 |
| 3,125,047 | 3/1964 | Kalning | 112/118 |
| 3,180,293 | 4/1965 | Caslr | 112/118 |
| 3,183,866 | 5/1965 | Walbert et al. | 112/103 X |
| 3,354,850 | 11/1967 | Story | 112/118 |
| 3,417,645 | 12/1968 | Brock | 112/121.14 X |
| 3,490,398 | 1/1970 | Anniel | 112/121.15 |
| 4,557,206 | 12/1985 | Iwase | 112/102 X |

FOREIGN PATENT DOCUMENTS

| | | | |
|---|---|---|---|
| 2856871 | 7/1979 | Fed. Rep. of Germany | 112/103 |
| 1550051 | 12/1968 | France . | |
| 1207451 | 10/1970 | United Kingdom . | |

*Primary Examiner*—Werner H. Schroeder
*Assistant Examiner*—Andrew M. Falik
*Attorney, Agent, or Firm*—Guido Modiano; Albert Josif

[57] ABSTRACT

A quilting machine for quilting mattress, bedspreads, comforters, and the like comprises a carriage on which an article to be quilted is held stretched. The carriage is guided by horizontal rails along which it is moved back-and-forth by a drive unit. Said carriage is overlaid by another carriage which is guided in an orthogonal direction to that of said first-mentioned carriage and carries one or more sewing heads. The latter carriage is driven by a unit which determines, in cooperation with the drive unit of said first-mentioned carriage, the relative movement of the sewing heads and cloth in accordance with a preset pattern for the seam line.

2 Claims, 5 Drawing Figures

QUILTING MACHINE WITH RELATIVELY MOVING CLOTH HOLDER CARRIAGE AND SEWING HEAD

BACKGROUND OF THE INVENTION

This invention relates to a quilting machine with relatively moving cloth holder carriage and sewing head in mutually orthogonal directions.

Currently available, commercially, are various quilting machine types which are employed for quilt working mattresses, bedspreads, comforters, and the like articles. One type, such as disclosed in U.K. Pat. No. 1,207,451, comprises a first carriage, on which a cloth to be quilted is held, arranged to run linearly on a second carriage. The latter carriage runs, also linearly, on an orthogonal plane to that of the first carriage.

Both carriages are driven to move under a stationary sewing head along a path determined by a template or other costraint.

Another type of a quilting machine, such as disclosed in French Pat. No. 1,550,051, operates in precisely the opposite way, i.e. with the sewing head moving along orthogonal axes over a stationary carriage holding a cloth to be quilted.

A further quilting machine type comprises one or more sewing heads which are driven back-and-forth relatively to a cloth which is being fed continuously lengthwise thereunder.

The first two of the types mentioned above can provide elaborate sewing. However, the carriage drive poses, on account of the inertia masses involved, somewhat narrow limits on operation, and the unavoidable shaking encountered adversely affects the quilting operation accuracy.

The quilting machine of the third type, alternatively, finds application for just repeatitive quilting of an inferior class.

SUMMARY OF THE INVENTION

It is a primary object of this invention to provide a quilting machine which can obviate such prior shortcomings, in particular by significantly attenuating the vibratory effects on the cloth holder carriage, so as to afford high quality sewing in a shorter time.

A further object of this invention is to provide a quilting machine which is highly flexible in operation, in connection with its ability to perform elaborate seam lines.

These objects are achieved by a quilting machine which is characterized in that it comprises a cloth holder carriage whereon a cloth to be quilted is stretched on a horizontal plane and which is movable along a rectilinear path, above said cloth there being arranged at least one sewing head guided in an orthogonal direction to the carriage travel direction, and a means being provided for driving said carriage and sewing head along respective runways to cause the seam line to follow a preset pattern.

BRIEF DESCRIPTION OF THE DRAWINGS

Further features of the invention will be more readily understood from the detailed description which discloses an embodiment thereof, as illustrated by way of example in the accompanying drawings, where:

FIG. 5 is a view, also to an enlarged scale, of the carriage as shown in FIG. 1.

DESCRIPTION OF THE PREFERRED EMBODIMENTS

Figure 1:
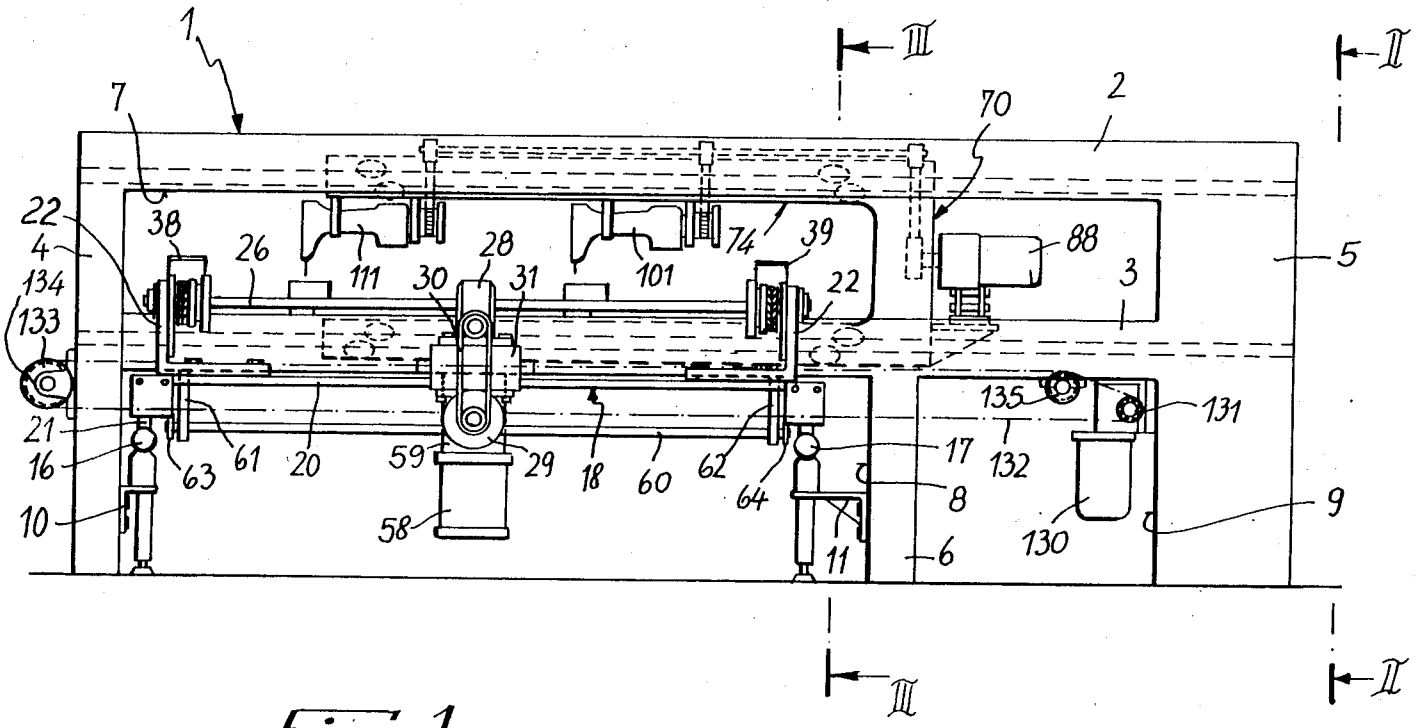
FIG. 1 is a front elevation view of a twin sewing head sewing machine according to the invention.

With reference to the drawing views, generally indicated at 1 is an overhead frame comprising an upper horizontal beam 2 and lower horizontal beam 3 which are supported at the opposed ends thereof by two floor-standing pillars 4,5. The lower beam 3 is supported by a third pillar 6 located intermediately between the pillars 4,5 but shifted toward the latter. The beams 2,3 have, when viewed in cross-section, the shape of two U's opening toward each other.

Between the beams 2,3 and pillars 4,5 there are defined two openings 7,8 of equal length the lower whereof is split in two by the intermediate pillar 6 to define an additional opening 9.

Attached to the inward faces of the pillars 4,6 are two brackets 10,11 which protrude from said pillars in horizontal alignment and to which two respective horizontal longitudinal stringers 12,13 are attached which extend parallel to each other and perpendicularly to the frame 1.

The longitudinal stringers 12,13 extend through the opening 8 to overhang on opposed sides of the frame 1. The ends of the longitudinal stringers 12,13 stand on the floor through substantially vertical adjustable height feet, 14 thereby enabling said longitudinal stringers to be supported on a truly horizontal plane. The longitudinal stringers have spacers 15 attached thereto to which are in turn attached two cylindrical bars 16,17 which serve as runways for a carriage 18 whereon a cloth to be quilted is to be stretched.

The carriage 18 comprises a rectangular frame formed by lengthwise 19 and crosswise 20 sectional members, having at its corners four idle wheels 21 which are grooved circumferentially and enable the carriage 18 to travel along the bars 16,17.

The crossmembers 20 have the horizontal portions of two pairs of right-angled elements 22,23 attached thereto.

Rigidly connected to the vertical portions of said two pairs of right-angled elements 22,23 are two pairs of plates 24 and 25 which support two parallel shafts 26,27 through bearings.

The shaft 26 is driven rotatively via a center reduction gear 28 which receives its motion from a motor 29 through a drive belt 30 and respective pulleys **28*a*,29*a* keyed on the output shafts of the reduction gear and motor. The motor 29 and reduction gear 28 are mounted on a box-like bracket 31 attached to the crossmember 20**.

Keyed on the shafts 26,27, at the opposed ends thereof, are respective pairs of output 32 and input 33 sprocket wheels which are in mesh engagement with two chains 34,35 trained therearound in closed loop configuration and being deflected by deflector wheels 36,37 to present two proximate, horizontal runs. Such horizontal runs are enclosed by shrouds 38,39 the end portions whereof are bent arcuately upwards above the sprocket wheels 32.

The links of the chains 34,35 comprise juxtaposed arms 40,41 (see FIG. 5) which project in opposed directions and carry blocks 42,43 bristling with outwardly facing needles 44,45. Keyed on the shaft 26, adjacently to, and rotating concurrently with the blocks 42,43, are disks 46,47 the outer diameter whereof is larger than that defined by the ends of the needles.

The needles have the purpose of holding the cloth to be quilted along two longitudinal edges. Penetration of the needles into the cloth is achieved by means of a pair of circular brushes 48 carried rotatably in arms 49 articulated to the ends of extensions 50 of the pair of right-angled elements 23.

The brushes 48 are coplanar with the needles 44, 45 and held against the latter by pneumatic jacks 51 interposed between the tops of said pair of right-angled elements 23 and oscillating arms 49. The cloth which should be stretched between the needles 44,45 is picked up by a roll 52 supported on a frame 53 which is attached to the carriage 18 through a hinge 54. The frame 53 has two feet 55 comprising rotatable wheels 56 which run on a pair of rails 57 secured on the surface and parallel with the rails 16,17.

The motion of the carriage 18 is derived from a gear motor 58 suspended, through brackets 59, from the lower beam 3 of the frame 1. The gear motor 58 drives a shaft 60 which is supported, at its opposed ends, on shoulders 61,62 projecting downwards from the beam 3.

Keyed to the ends of the shaft 60 projecting beyond the shoulders 61,62 are pinion gears 63,64. On each shoulder 61,62 are cantilevered a pair of idle gear wheels 65,66 lying on the same plane as the pinions 63,64 but on opposite sides with respect to the latter.

The pairs of gear wheels 65,66 keep trained at a certain angle around the pinion gears 63,64 two chains 67 stretched between the front and rear crossmembers 20 of the carriage 18 to form two racks which are in mesh engagement with said pinion gears 63,64.

Figure 3:
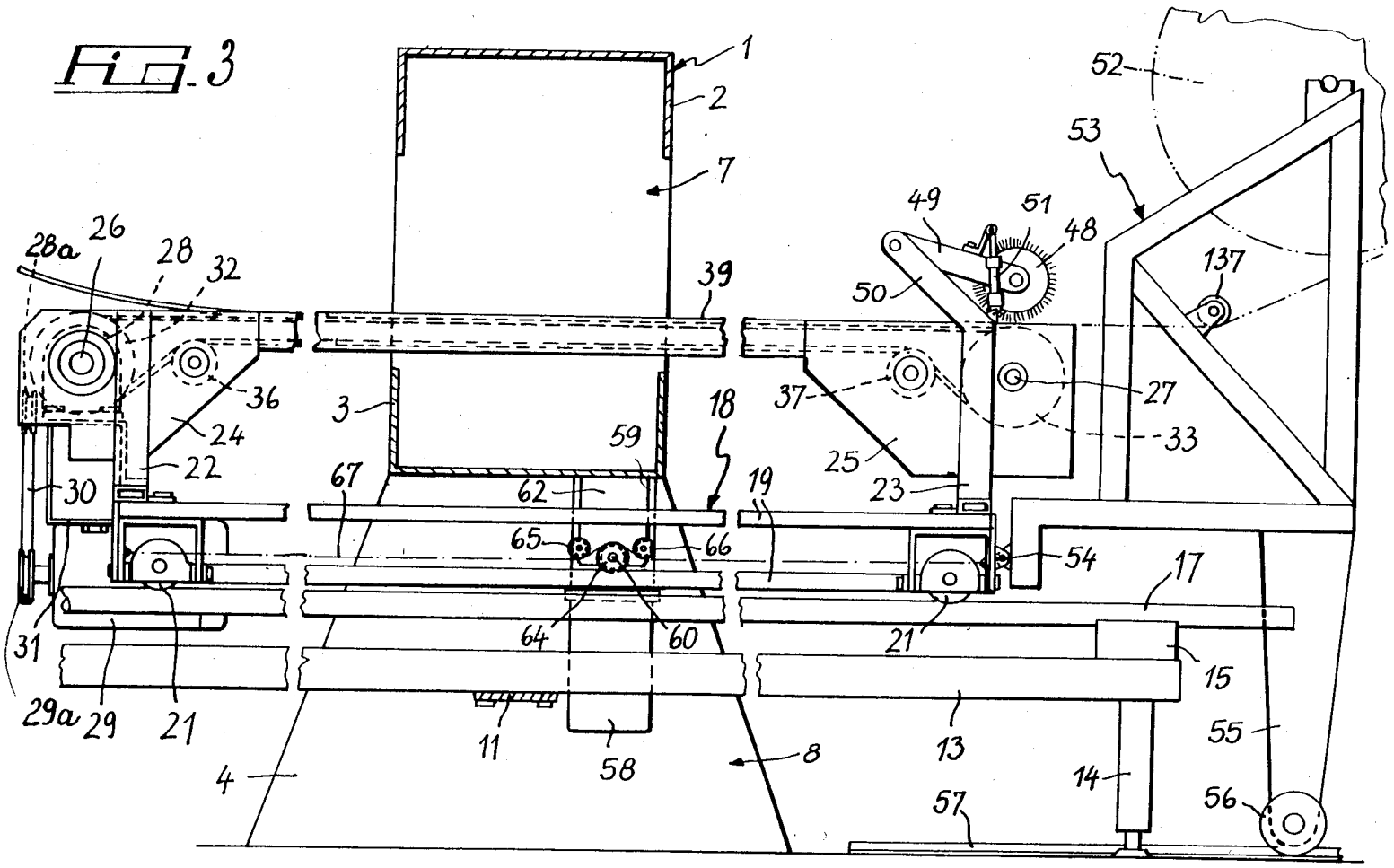
FIG. 3 is a view taken on the plane III—III of FIG. 1.

As illustrated in FIG. 3, the chains 34,35 are passed through the opening 7 as the carriage frame moves through the opening 8, thereby the beam 3 is located under the chains 34,35 and over the longitudinal stringers 19.

Inside the beams 2,3, and extending over the full length of the latter, are two pairs of guide bars 68, 69 supporting the sewing head carriage 70.

The bars 68,69 have a square cross-section and are positioned edgewise on the sidewalls of the beams 2,3 by means of diagonal elements 71,72 whereto they are attached.

Figure 4:
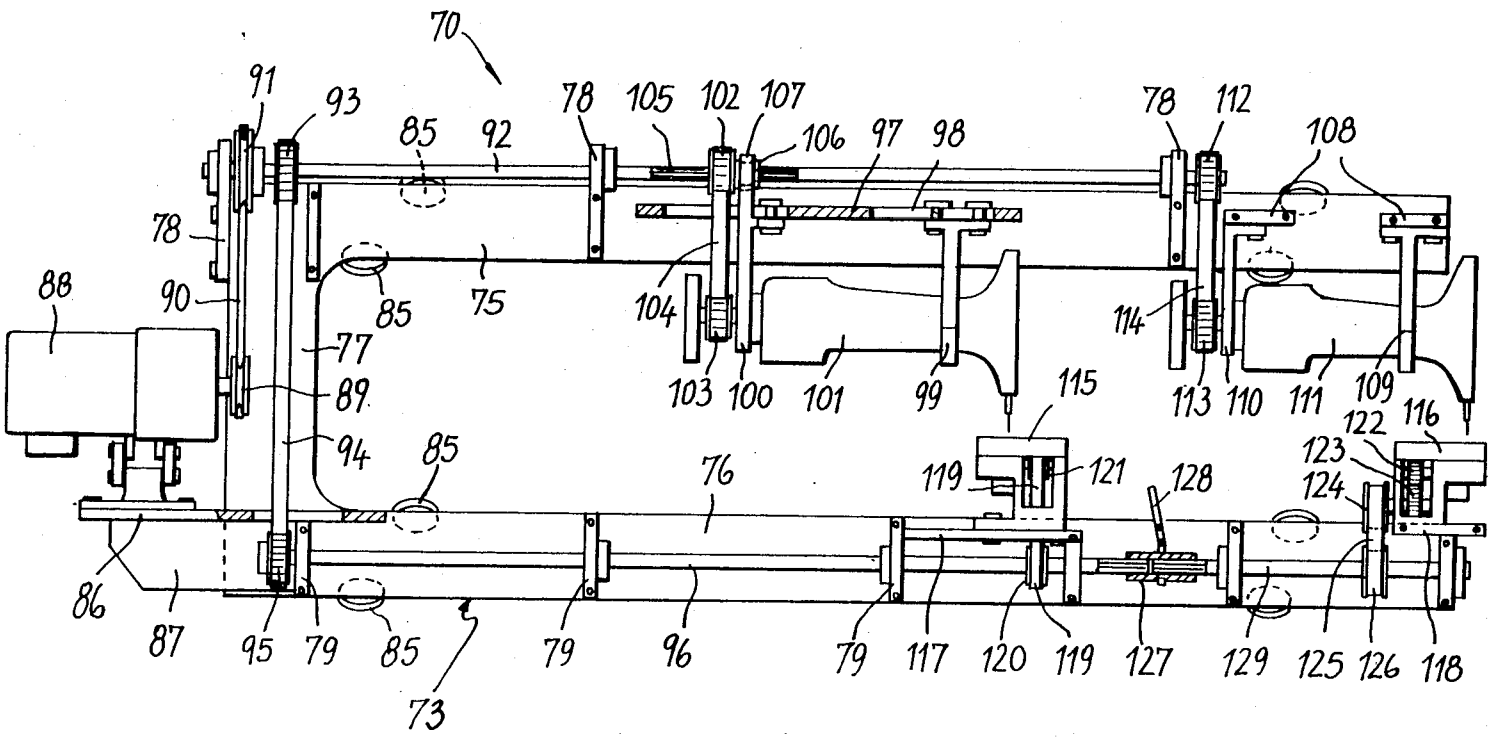
FIG. 4 is a view taken on the plane IV—IV of FIG. 2 and to an enlarged scale.

The carriage 70 comprises two plane parallel plates 73,74 identical to each other and shaped like a "C" with two horizontal portions 75,76 which extend into the beams 2,3 and are connected through vertical portions 77 (see FIG. 4).

The plates 73,74 are interconnected by partitions interposed between the horizontal upper portions 75 and partitions 79 interposed between the horizontal lower portions 76. Attached to the outer faces of the plates 73,74 are pairs of small blocks 81,82,83 and 84, of which the first pair are rigid with the upper portions 75 and the second pair with the lower portions 76. Cantilevered from each block 81–84 are a pair of small rollers 85 having their rotation axes arranged at 90° to each other and in tangential rolling engagement with the juxtaposed faces of the bars 68,69. Mounted between the vertical portions 77 of the carriage 70 is a bracket 86 which projects from the vertical portions 77 in the opposite direction to the horizontal portions 76.

On the bracket 86, which is strengthened by underlying ribs 87, there is mounted an electric motor 88 with a shaft whereto the drive pulley 89 is keyed. Trained around the pulley 89 is a belt 90, which is also trained around the driven pulley 91.

The pulley 91 is keyed to a shaft 93 which is journaled within, and carried rotatably in between two partitions 78 and extending on the centerplane of the carriage between the upper portions 75 over nearly the full length of the latter. Keyed to the shaft 92, beside the pulley 91, is a positive drive sprocket wheel 93 which, through a toothed belt 94, transmits the motion to a second sprocket wheel 95 rotatively keyed to a shaft 96 journalled at the partitions 79. The shaft 96 is parallel to the upper shaft 92 and extends between the horizontal lower portions 76, of the carriage 70.

Fastened between the upper portions 75 is a plate 97 having slots 98 extending parallel to the shaft 92.

Suspended from the plate 97, by means of brackets 99,100 is a sewing head 101 of conventional design, which receives its motion from the shaft 92 through a drive including two sprocket wheels 102,103 and a corresponding toothed belt 104. The pulley 102 is rotatively rigid with a splined portion 105 of the shaft 92 and has a circumferentially grooved side bushing 106, with which engages a yoke 107 presented at the top of the bracket 100. Thus, on loosening the fastening bolts of the brackets 99,100 from the plate 97 it becomes possible to shift the sewing head along the plate itself and the pulley 102 along the splined portion 105. Likewise, between the ends of the upper portions 75, there are arranged two plates 108 from which a second sewing head 111 is suspended through brackets 109,110, stationary relatively to the carriage 70. This sewing head also receives its motion from the shaft 92 through a drive including two sprocket wheels 112,113 and a corresponding toothed belt 114.

Cooperating with each of the sewing heads 101,111 are respective "hook" devices 115,116 mounted on respective plates 117,118 interposed between the carriage lower portions 76.

The hook device 115 can be shifted across the plate 117 to proceed the displacement of the sewing head, whereas the device 116 is stationary. The device 115 receives its motion from the shaft 96 via a belt drive 119 which is trained around a pulley 120 keyed to the shaft 96 and a pulley 121 keyed to a shaft suitably journaled within the hook device 115. The device 116 is juxtaposed to the device 115, in order to extend the lateral bounds of the sewing machine working range and improve access to the cops thereby facilitating their replacement. To obtain the same direction of rotation for the hook, however, a reversing gear is provided which comprises two gear wheels 122,123 accommodated in the device and meshing together, of which the wheel 122 drives the hook and the other wheel 123 is secured on the axle carrying the pulley 124 which receives its motion from the shaft 96 through the belt 125 and pulley 126. It should be noted that the shaft 96 is divided into two sections which may be coupled together by means of an axially sliding splined bushing 127. The bushing 127 is in constant rotary engagement with the end of one section and can overlap the end of the adjacent section to rotatively engage the latter on operation of a yoke lever 128 journalled between the portions 76. Thus, it becomes possible to isolate the end section 129 of the shaft 96 from the drive means 88–95 when the second sewing head 111 is not to be operated (see FIG. 4).

Figure 2:
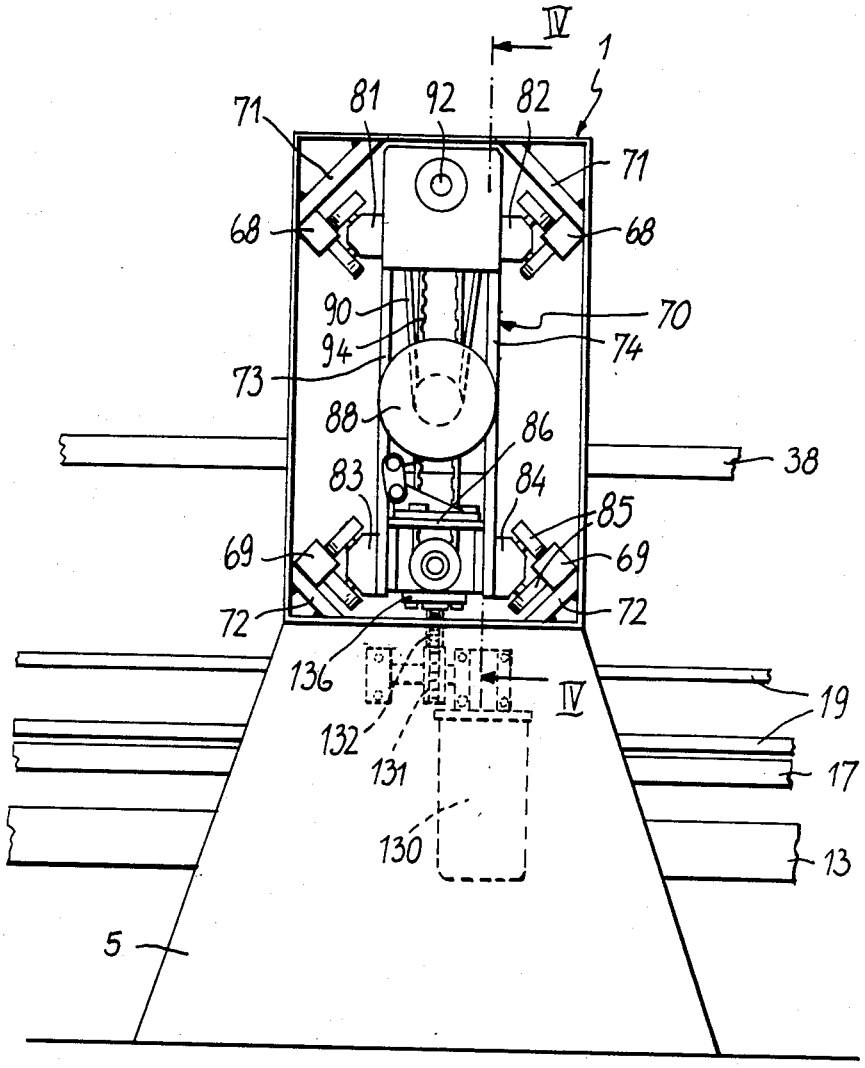
FIG. 2 is a view taken on the plane II—II of FIG. 1.

The movement of the carriage 70 along the guides 68, 69 is generated by a gear motor 130 having a sprocket wheel 131 around which a chain 132 is trained. The lower run of the chain 132 extends below the beam 3 through openings in the pillars 4 and 6 and is passed around a sprocket wheel 133 journalled axially in a support 134 attached to the outside of the pillar 4. The upper run of the chain 132 extends into the beam 3 and is deflected away from the axis of said sprocket wheel 131 by an idle roller 135, thereby defining a horizontal trajectory, parallel to said lower run. One point on the chain upper run is secured to the carriage 70 by means of a small plate 136 (FIG. 2).

The quilting machine described hereinabove operates as follows. First, the cloth is positioned on the carriage 18. To accomplish this, the cloth is unwound from the roll 52 and deflected horizontally by a roller 137 on the frame 53 (FIG. 3) under the brushes 48 which drive its edges onto the needles 44, 45. The driving of the chains 34,35 generated by means of the motor 29 causes the desired length of cloth to be fed a corresponding distance under the sewing heads and over the respective hook devices.

Then, the sewing step begins with the actuation of the motor 88 which powers the sewing heads 101,111 and hook devices 115,116.

Simultaneously the motors 58 and 130 are operated to move the cloth holding carriage 18 along the rails 16,17, and respectively, the carriage 70 along the bars 68,69. The orthogonal reciprocating movements of the carriages 18 and 70 enable the formation of any seam lines and, hence, of an indefinite range of patterns.

The carriage drive motors are suitably controlled by an electronic processor. It is possible, however, to perform the quilting operations by controlling the carriages through a tracer point arranged to follow a template.

On completion of the quilting operations, a fresh cloth section paid out from the roll 52 can be stretched between the chains 34,35, while the completed quilted cloth section is simultaneously ejectd from the carriage 18. Disengagement of the needles 44,45 is accomplished by the disks 46,47 which, having a larger diameter, than that defined by the ends of said needles, will raise the cloth edges off the needles as the cloth is on the point of leaving the carriage. The machine may be equipped with a cutter device to sever the completed quilted cloth section from the remaining cloth.

It may be appreciated that the invention fully achieves its objects. In particular, it is to be noted that the cloth to be quilted is only allowed to move in one direction, thus greatly reducing the margin for errors due to the carriage being stopped and restarted.

An additional advantage is that the moving masses are reduced to permit higher speed operation.

Particularly advantageous has proved to be the use of several sewing heads placed at adjustable mutual spacings to optimize performance and, simultaneously achieve highly versatile operation features regarding cloth size and effectuation of complex pattern seam lines.

The invention as disclosed is susceptible to many modifications and changes. One of these envisages, for instance, that a frame be used instead of the chains 34,35 whereon the cloth would be stretched and held down by suitable clamps. Another modification provides for the roll of cloth to be either supported directly on the carriage or held stationary on the floor. The quantity of rolls may vary according to the number of layers composed within the manufactured article.

We claim:

1. A quilting machine comprising a first carriage, means for moving said carriage along a rectilinear path, means provided on said carriage for holding a cloth to be quilted in stretched condition on a horizontal plane, a second carriage movable along horizontal beams orthogonally arranged to said rectilinear path, said second carriage comprising two parallel plates interconnected by partitions and having a C-like shape defining horizontal portions which extend over and under the cloth to be quilted, sewing heads supported on said portions extending over the cloth, and respective hook devices cooperating with said sewing heads and mounted on said portions extending under the cloth, chain means provided on said cloth holding carriage and stretched to form a rack extending in the direction of movement of said cloth holding carriage and a gear motor mounted on said beams and having a pinion engaging said rack for driving said cloth holding carriage in either direction.

2. A quilting machine according to claim 1, wherein for holding the cloth a pair of closed-loop powered chains are provided on said cloth holding carriage having two parallel runs, said chains including links wherewith holding arms are made rigid with blocks supporting a plurality of needles pointing upwards and acting as members adapted to engage the side edges of the cloth to be quilted.

* * * * *